United States Patent [19]

Zysset

[11] Patent Number: 4,535,909

[45] Date of Patent: Aug. 20, 1985

[54] EASY OPENING CONTAINER SYSTEM

[75] Inventor: Edgar H. Zysset, St. Cloud, Fla.

[73] Assignee: Automated Container Corporation, Orlando, Fla.

[21] Appl. No.: 592,831

[22] Filed: Mar. 23, 1984

[51] Int. Cl.[3] ..... B65D 17/36

[52] U.S. Cl. ..... 220/273

[58] Field of Search ..... 220/269–273

[56] References Cited

U.S. PATENT DOCUMENTS 4,042,144 8/1977 Henning et al. ..... 220/273

4,394,927 7/1983 Zysset ..... 220/273

*Primary Examiner*—George T. Hall

[57] ABSTRACT

An easy open pull tab system and method is adapted for use with a container of the type having a weakened score line, the severing of which permits access to the container. A fastener is joined to the container end and spaced from the score line, with a pull tab joined to the fastener through an octagonal hole, the tab having a pull ring extending from the fastener in a direction away from the score line. The pull tab includes a nose portion extending adjacent to the score line to permit the desired severing upon pulling of the pull ring in a direction away from the container end. The tab is formed with a continuous peripheral curl extending along two beams forward to the nose portion, and is provided with only two carrier lugs on opposite sides of the pull ring for use in the manufacturing of the tab. The container end is provided with a crimped ridge designed to abut a flat metal strip through which the fastener is connected to the container, to limit axial rotation of the tab about the fastener.

21 Claims, 5 Drawing Figures

EASY OPENING CONTAINER SYSTEM

BACKGROUND OF THE INVENTION

1. Field of the Invention

The present invention relates to containers, particularly containers for foodstuffs. More specifically, the present invention is directed to a pull tab system of the easy open type, and methods for manufacturing such easy open pull tabs.

2. Description of the Prior Art

There are a wide variety of easy-open pull tab configurations known in the prior art. Many of these designs and configurations are adapted for a specific use, or in conjunction with a specific metal gauge. Generally, however, there are two types of easy open pull tabs, which can be categorized by the manner in which each functions.

The first category includes those easy open pull tabs designed with a solid, attached rivet hole panel so as to fracture a vent score (commonly referred to as a "moustache", because of its shape) in order to create a fulcrum point for the tab to turn as it is lifted higher above the plane of the end panel. The nose then pierces the score line of the end panel for easy removal.

The second category of easy open pull tab systems are designed with a rivet hole panel independent of the tab body on three sides, but attached to the side opposed to the tab nose. The attached side becomes the fulcrum point between the tab body and the rivet hole.

Typically, pull tab systems are fabricated from flat metal stock using conventional metal stamping and forming techniques. Because large quantities of the pull tabs must be manufactured at one time, it is customary to stamp the tabs in flat strips, permitting the tabs to remain attached to the strip via so called "carrier lugs", which are simply portions of the metal which are not removed until near the end of the fabrication sequence. Heretofore, carrier lugs have been positioned at both ends of the pull tab configuration, usually at the nose portion and along both sides; in some cases, prior art easy open pull tabs have been constructed without carrier lugs being located along the pull ring portion, in order to avoid any sharp edges which might cause injury to the consumer while the pull tab ring is being used for opening.

It is also known to fabricate pull tabs with rivet holes having a six-sided (hexagon) shape, to lock the rivet in the hole after crimping.

Prior art patents which generally describe easy open pull tab arrangements and methods for manufacturing include the following: U.S. Pat. Nos. 3,850,124 to Brown; 4,026,226 to Hahn, et al; and 4,130,074 to Cudzik.

SUMMARY OF THE INVENTION

The present invention is directed to an easy open pull tab system and method, in which the only carrier lugs utilized in the fabrication of the pull tab are located on opposite sides of the back of the pull ring, thus leaving free the entire length of the beams between the pull ring and the nose portion for the forming of a peripheral, continuous curl.

A container having an easy open pull tab in accordance with the present invention is adapted for use with a container end having a weakened score line, the severing of which permits access to the container. A fastener (such as a rivet) is joined to the container end and spaced from the score line. A pull ring extends from the fastener in a direction away from the score line, and a nose portion extends adjacent to the score line to permit the severing of the score line upon pulling of the pull ring in a direction away from the container end. The peripheral, continuous curl provides means for strengthening each of the beam continuously along the length from the pull ring to the nose portion.

In accordance with the preferred embodiment of the present invention, the pull tab further comprises a flat strip extending from the nose portion toward the pull ring, the flat strip being disposed inwardly from the pull tab toward the end, with the fastener extending through an eight-sided (octagonal) hole in the flat strip. The container end includes a crimped ridge abutting the rearward edge of the flat strip, so as to limit axial rotation of the pull tab about the fastener.

In accordance with the method of the present invention, the easy open pull tab is fabricated from a sheet of flat metal stock, utilizing at least first and second carrier lugs, with all of the carrier lugs positioned rearwardly of the axis of the fastener, preferably only along the rear peripheral edge of the pull ring, and spaced a distance apart by an inward curl to prevent injury to the consumer during the pull tab opening operation.

DETAILED DESCRIPTION OF THE PREFERRED EMBODIMENT

Figure 1:
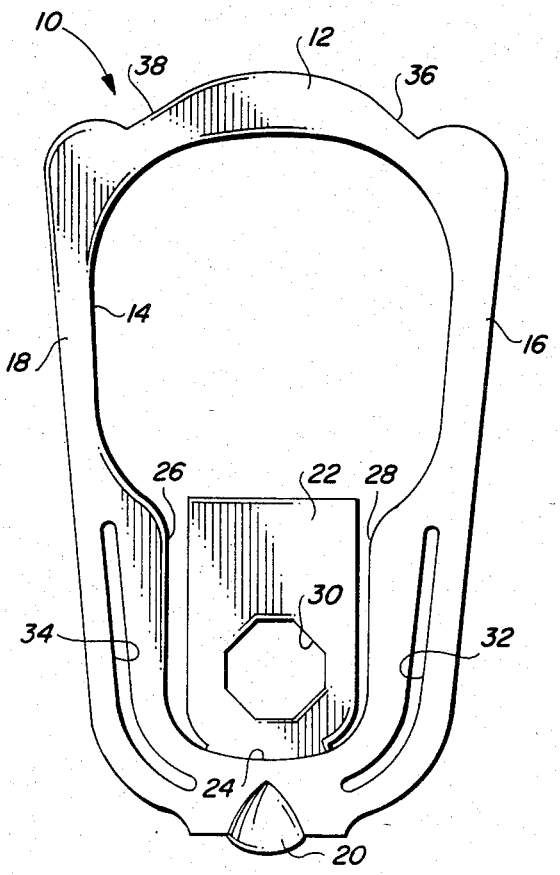
FIG. 1 is a top plan view of an easy open pull tab in accordance with the present invention.
Figure 2:
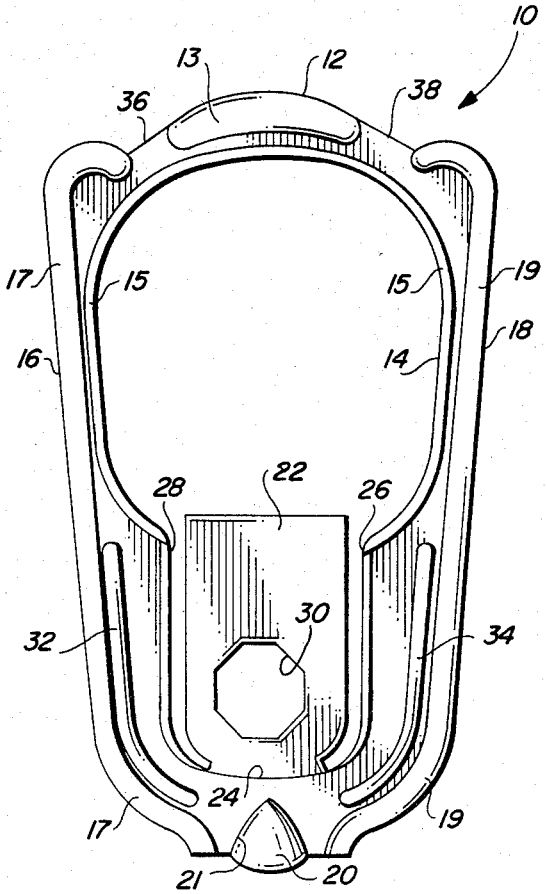
FIG. 2 is a bottom view of the pull tab of FIG. 1.

Referring first to FIGS. 1 and 2, an easy open pull tab construction in accordance with the present invention is referred to generally by the reference numeral 10. As earlier described, the pull tab is fabricated from a flat sheet of metal stock by conventional stamping and metal forming techniques.

The pull tab 10 includes a pull ring 12 defining an inner, generally annular opening 14 and with a pair of elongated beams 16, 18 formed continuously with the pull ring 12 and extending forward to a nose portion 20. As is more fully described with reference to FIGS. 3 and 4 below, the nose portion 20 defines a forward extremity adapted to engage and sever a conventional score line in an end panel of a container.

Figure 4:
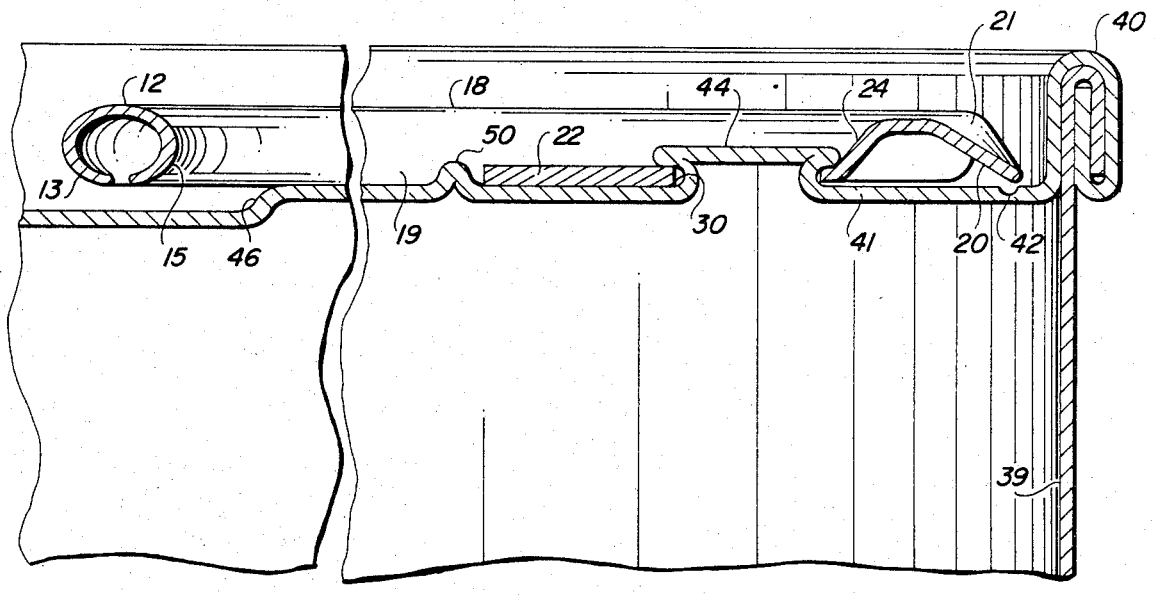
FIG. 4 is a cross sectional elevation of the container—pull tab combination of FIG. 3, taken along the line 4—4.

The pull tab 10 further includes a flat strip 22 extending rearwardly from the nose portion 20 and indented downwardly from the general plane of the tab 10 along a break line 24; the configuration of this break line is best seen by specific reference to FIG. 4. The flat strip 22 is defined by a pair of slots 26, 28, each slot extending between the strip 22 and the adjacent one of the beams 16, 18. Each slot 26, 28 extends in a forward direction toward the nose portion 20, but angles inwardly at the break line 24. The flat strip 22 further includes an octagonal hole 30 adapted to receive a fastener, such as a rivet 44 (note FIG. 4).

It has been found that the octagonal hole 30 provides substantially better locking characteristics than previously achieved with a six-sided (hexagonal) hole.

A pair of strengthening indentations 32, 34 extend along each of the respective beams 16, 18 and angle inwardly toward the nose portion at the forward extremity of each indentation (note FIG. 1).

As is further shown in FIGS. 1 and 2, the pull tab 10 includes a pair of flat "cutouts" 36, 38 which cutouts indicate the location of the only two carrier lugs associated with the pull tab 10 during the manufacturing thereof. The use of these carrier lugs is more fully described below with reference to FIG. 5.

Referring now to FIG. 2, it is seen that the pull ring 12 is provided with a peripheral curl 13 formed by rolling the flat stock inwardly and underneath. Similarly, the inner periphery 14 of the pull ring 12 along the beams 16, 18 is also provided with a peripheral curl 15 formed in a similar manner. The peripheral curls 13 and 15 abut each other so as to provide a surface which will not cut or injure the consumer during the opening operation.

In a similar manner, each of the beams, 16, 18 is provided with a corresponding outer peripheral curl 17, 19. Each of the peripheral curls 17, 19 extends continuously from the corresponding carrier lug cutout 36, 38 forward to a point adjacent the nose portion 20. In this way, the peripheral and continuous beam curls 17, 19 substantially strengthen the overall construction of the pull tab 10, than is otherwise realized when the carrier lug cutouts are located along each of the beams, such as has been used in the prior art.

As is further shown in FIGS. 2 and 4, the nose portion 20 is indented downwardly with respect to the plane of the stock material from which the tab 10 is fabricated, the periphery of the indentation being defined by reference numeral 21.

Figure 3:
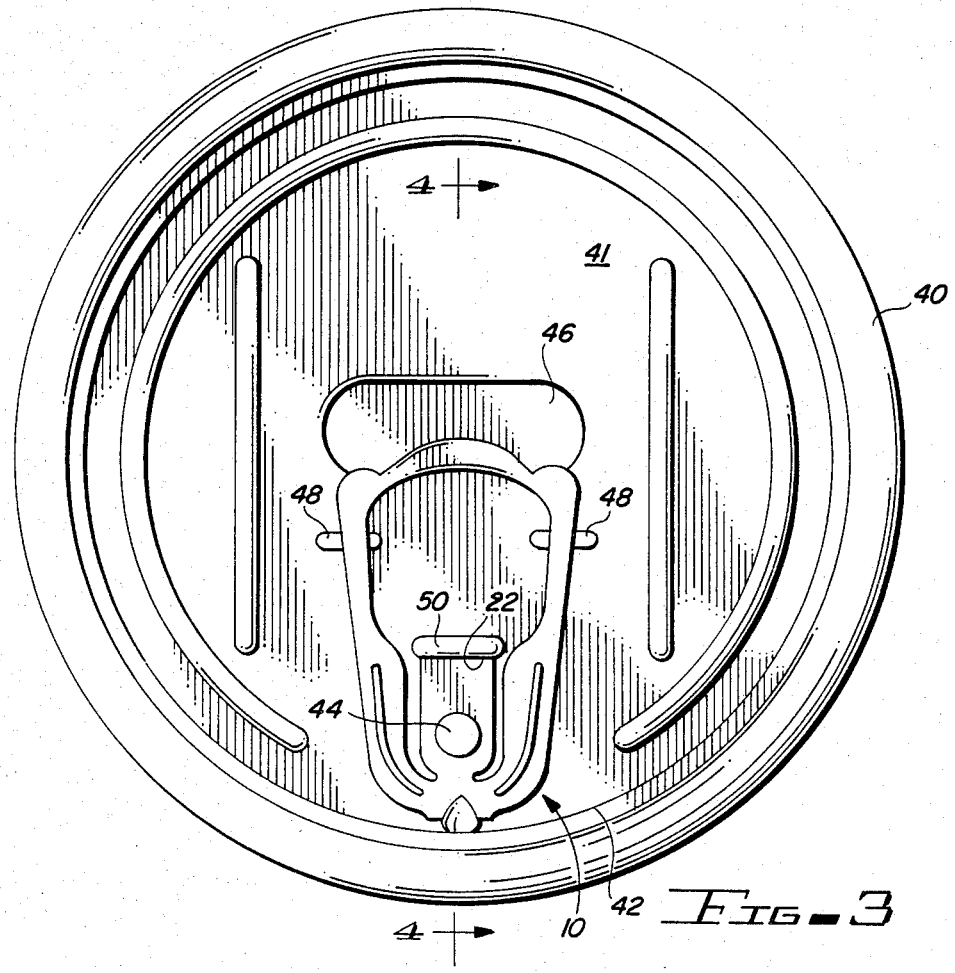
FIG. 3 is a top plan view of a pull tab—end panel constructed in accordance with the present invention.

Use of the pull tab 10 with a container and the associated end is shown in FIGS. 3 and 4 and described with reference thereto.

Noting FIG. 4, numeral 39 refers to the sidewall of the container in which an end panel is attached; the end panel is defined by a peripheral curl 40 attached to the sidewall 39 of the container, and a generally flat field 41 to which the easy open pull tab 10 is attached via a rivet 44 extending through the octagonal rivet hole 30. The nose portion 20 of the pull tab 10 is positioned over and immediately adjacent to a continuous weakened score line 42 around the outside periphery of the flat field 41 of the end panel.

The end panel 40, 41 includes an indentation 46 extending downwardly away from the pull ring 12 underneath the peripheral curls 13, 15 to permit a consumer to extend a fingernail or other object underneath to begin to pull tab removal procedure. As is shown in FIG. 3, the end panel further includes a pair of upward indentations 48 designed to support the opposing beams 16, 18. The end panel further includes an upwardly extending crimped ridge 50 parallel with the rearward end of the flat strip 22 of the pull tab 10 and immediately adjacent thereto, to limit axial rotation of the pull tab 10 about the rivet 44.

The method of manufacturing the easy opening pull tab 10 of the present invention will now be described with reference to FIG. 5, which shows four of the fabrication steps.

Figure 5:
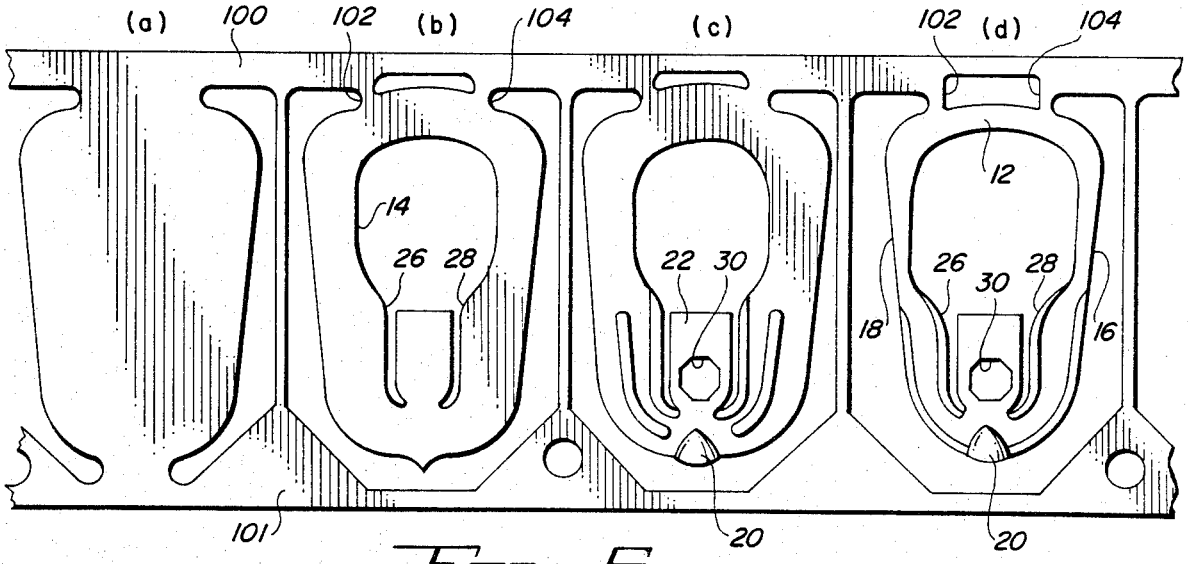
FIG. 5 is a top plan view illustrating one step in the fabrication of easy open pull tabs in accordance with the present invention.

As is shown in FIG. 5, there is provided a flat metal stock material subjected to conventional stamping operations, and including a pair of carrier rails 100, 101 common to all of the pull tabs being fabricated. A pair of carrier lugs 102, 104 corresponding to the flat cutouts 38, 36 respectively are provided (note position (b) in FIG. 5). As an initial stamping operation, the annular hole 14 is defined, together with the slots 26, 28. In another step, the flat strip 22 is formed together with the octagonal rivet hole 30, and the downwardly extending portion of the nose 20 is formed (note step (c) in FIG. 5). Thereafter, as is shown in step (d), the peripheral curls are formed. It will be understood by those skilled in the art that the carrier lugs 102, 104 provide the only contact with the upper carrier rail 100, thus permitting the peripheral curls 17, 19 associated with the beams 16, 18 to be formed continuously from the pull ring 12 to the nose portion 20, to provide for a pull tab having desirable strength characteristics along the continuous length of each of the beams 16, 18.

As previously noted, the octagonal hole 30 provides substantially better locking characteristics along the facets of the hole than has previously been achieved through the use of six sided rivet holes. A hole with as many as ten sides (a decagon) should provide the same characteristics as an octagon as well.

I claim:

1. A container having a pull tab for the easy opening thereof, said container comprising:

a container having an end with a weakened score line the severing of which permits access to said container;

a fastener joined to said container end and spaced from said score line;

a pull tab joined to said fastener and having a pull ring extending from said fastener in a direction away from said score line and a nose portion extending adjacent said score line, said tab further including a pair of beams, each beam extending from said pull ring to said nose portion;

means for strengthening each of said beams continuously along the length from said pull ring to said nose portion; and first and second carrier lug cutouts spaced along the rearward portion of said pull ring, with a lifting portion between said carrier lugs and with a peripheral curl along said lifting portion.

2. The container recited in claim 1 wherein said fastener comprises a rivet extending through said end and said pull tab.

3. The container recited in claim 2 wherein said pull tab further comprises a flat strip extending from said nose portion toward said pull ring, said flat strip being disposed inwardly from said pull tab toward said end, with said rivet extending through said flat strip.

4. The container recited in claim 1 wherein said strenthening means comprises a peripheral curl extending toward said container end and continuously along each beam from said pull ring to said nose portion.

5. The container recited in claim 1 further comprising a rigidizing indentation along each beam between said ring and said nose portion.

6. The container recited in claim 3 wherein said pull tab further includes two slots, each slot extending between said flat strip and the adjacent one of said beams.

7. The container recited in claim 6 wherein the termination of each said slot extends inwardly toward said nose portion.

8. The container recited in claim 3 wherein said strengthening means comprises a peripheral curl extending toward said container end and continuously along each beam from said pull ring to said nose portion.

9. The container recited in claim 3 further comprising a rigidizing indentation along each beam between said ring and said nose portion.

10. The container recited in claim 1 further comprising means for limiting axial rotation of said pull tab about said fastener.

11. The container recited in claim 10 wherein said rotation limiting means comprises a ridge extending from said container end into engagement with said pull tab.

12. The container recited in claim 10 wherein said rotation limiting means comprises said fastener extending an octagonal hole in said pull tab and crimped thereto.

13. The container recited in claim 1 wherein said first and second carrier lug cutouts comprise the only carrier lug locations along the periphery of said pull tab.

14. A container having an easy opening pull tab, comprising:

a container with an end having a weakened score line the severing of which permits access to the container;

a fastener joined to said container end and spaced from said score lines;

a pull tab joined to said fastener and having a pull ring extending from said fastener in a direction away from said score line, and a nose portion extending adjacent to said score line to permit the severing of said score line upon pulling of said pull ring in a direction away from said container end;

means for limiting axial rotation of said pull tab about said fastener; and first and second carrier lug cutouts spaced along the rearward portion of said pull ring, with a lifting portion between said carrier lugs and with a peripheral curl along said lifting portion.

15. The container recited in claim 14 wherein said pull tab further comprises a pair of beams, each beam extending from one side of said nose portion to one side of said pull ring.

16. The container recited in claim 15 further comprising means for strengthening each of said beams continuously along the length thereof from said pull ring to said nose portion.

17. The container recited in claim 16 wherein said strengthening means comprises a peripheral curl extending towards said container end and continuously along each beam from said pull ring to said nose portion.

18. The container recited in claim 14 wherein said pull tab further comprises a flat strip extending from said nose portion and towards said pull ring, said flat strip being disposed inwardly from said pull tab toward said end, with said fastener extending through said flat strip.

19. The container recited in claim 18 wherein said pull tab further includes two slots, each slot extending between said flat strip and the adjacent one of said beams.

20. The container recited in claim 19 wherein the termination of each said slot extends inwardly towards said nose portion.

21. A container having an easy opening pull tab, comprising:

a container with an end having a weakened score line the severing of which permits access to the container;

a fastener joined to said container end and spaced from said score lines;

a pull tab joined to said fastener and having a pull ring extending from said fastener in a direction away from said score line, and a nose portion extending adjacent to said score line to permit the severing of said score line upon pulling of said pull ring in a direction away from said container end;

carrier lug means including at least one carrier lug cutout along the rearward portion of said pull ring, with a lifting portion adjacent said carrier lug cutout and with a peripheral curl along said lifting portion; and wherein said carrier lug means along said rearward portion comprises the only carrier lug location along the periphery of said pull tab.

* * * * *